United States Patent [19]

Coomes et al.

[11] Patent Number: 4,520,715

[45] Date of Patent: Jun. 4, 1985

[54] ENERGY-SAVING COVER APPARATUS FOR ROOM AIR REGISTERS

[76] Inventors: Raymond G. Coomes; Pamela R. Coomes, both of 10250 N. Volk, Marana, Ariz. 85238

[21] Appl. No.: 622,831

[22] Filed: Jun. 21, 1984

[51] Int. Cl.[3] ..... F24F 7/00

[52] U.S. Cl. ..... 98/101; 98/119

[58] Field of Search ..... 98/29, 94 AC, 101, 103, 98/108, 116, 119

[56] References Cited

U.S. PATENT DOCUMENTS

| | | | |
|---|---|---|---|
| 1,274,996 | 8/1918 | Davis | 98/101 |
| 1,493,655 | 5/1924 | Vernon | 98/119 |
| 2,731,104 | 1/1956 | Baker et al. | 98/2.11 |
| 2,800,852 | 7/1957 | Shaberman | 98/108 |
| 3,046,719 | 7/1962 | Tropiano | 55/417 |
| 3,115,082 | 12/1963 | Sanoff | 98/101 X |
| 3,227,064 | 7/1966 | Spangle | 98/109 |
| 4,047,475 | 9/1977 | Cox | 98/116 |
| 4,050,365 | 9/1977 | Freeman, Jr. | 98/40 C |
| 4,226,174 | 10/1980 | Vesper | 98/109 |
| 4,287,815 | 9/1981 | Henderson | 98/29 X |

*Primary Examiner*—Harold Joyce

*Attorney, Agent, or Firm*—Victor Flores

[57] ABSTRACT

An energy-saving cover apparatus for use in homes, mobile homes or any building in general, having room air registers. The cover apparatus is intended to solve the problem of losing heated room air through inadequately closed louvers of the conventional room air register when another heating system is being used to heat up the room. The apparatus is of inexpensive construction and can be quickly attached to the face of the conventional room air register. The apparatus is comprised of a cover means and a register attachment means. The cover means is described in two embodiments, firstly, a closed cell cellulose fibrous material is adhesively attached to a solid material on the frontside and suitably sized to fit the face of the conventional room air register. The register attachment means for this construction is a latching mechanism having a cover latching shank portion and a register attachment portion. Secondly, the same type of fibrous material is provided on the backside with a plurality of strips of material sold under the tradename of Velcro and with a soft paper-like material on the frontside. Mating halves of the tradename Velcro material are suitably attached to the face of the register to provide a releasable connecting means.

2 Claims, 6 Drawing Figures

ENERGY-SAVING COVER APPARATUS FOR ROOM AIR REGISTERS

BACKGROUND OF THE INVENTION

1. Field of the Invention

The present invention generally relates to dampers or the like used in room air registers and more particularly, is concerned with a novel energy-saving cover apparatus which complements and improves the damper function of present room air registers which are intended to be covered while a separate heating system is in operation. The energy-saving cover apparatus is especially useful for covering and preventing the loss of heat or energy through the cooling air vents or registers in mobile homes having separate heating and cooling systems. The novel energy-saving cover apparatus is designed with an attachment means which will allow the homeowner or building maintenance person to quickly install or remove, as desired, the cover apparatus from the existing room air register.

2. Description of the Prior Art

The idea of providing dampers in room air register is well known in the art. One method known is to provide a shutter at the exit end of the air ducting which would be opened in a hinged manner by the force of the air coming through the register or the like. This damper method has disadvantages in that the seal to close off any return air depends upon air pressure which is generally insufficient in a normal room in a home. Another damper method, and perhaps most common in present room air registers, is one where the register is provided with a plurality of closely spaced louvers which are controlled by an external means to either an open position or a closed position. The closed position of this type of damper is intended to have the louvers closely overlap each other and thus impede the flow of air through the air register. This type of register in a closed position is intended to prevent the escape of warm room air while a separate heating system not using the same air register is heating the room. In the open position this type of register provides an outlet for cool air from a cooling system. A close look at the louvers in a closed position will reveal that air can readily pass therebetween and thus such overlapping arrangement of louvers is not providing an effective seal to prevent the loss of heat from a room in a home or any building in general. An alternative damper method known is one where a single-piece damper structure is placed within the ducting immediately behind the register and having an external control mean to place the damper in a vertically closed position or a horizontally open position. This type of damper also has the disadvantage of not providing an adequate seal to prevent the loss of heat from a room in a home or any building in general.

Other techniques which have been employed to improve upon the effectiveness of the present dampers in room air registers involve the installation of weather stripping material or the like to fill any voids in the damper through which heated air may escape. Other related devices known do not address the damper field and generally pertain to air diffusing means or to humidifiers which may be attached to room air registers. Therefore, the prior art does not provide a damper in room air registers to adequately seal and thus prevent the loss of heated air. The presently available room air registers, with their associated dampers, are a major contributor to waste of energy. Thus, a need exists for a better damper in room air registers or alternatively an apparatus which will complement the presently available dampers to prevent the loss of heat and thus reduce the high consumer heating bills and conserve on energy.

SUMMARY OF THE INVENTION

It has been noted that the room air registers presently provided in homes, mobile homes or any building in general are a major contributor to the loss of heat, hence a waste of precious energy. Therefore, it is a principal object of the present invention to provide the homeowner, or owners of building in general, with an inexpensive, energy-saving cover apparatus which will attach to an existing room air register and prevents the loss of heat through the associated room air register damper means.

Another object of the invention is to provide the homeowner or building maintenance person with an inexpensive, energy-saving cover apparatus which will solve the problem of losing heat through the dampers in room air registers and which will be quickly installed to an existing room air register by an unskilled laborer or homeowner without the use of any special tools other than a screwdriver and a small wrench.

Yet another object of the invention is to provide the homeowner or building maintenance person with an inexpensive, energy-saving cover apparatus which will solve the problem of losing heat through the dampers in room air registers and which can be quickly installed to an existing room air register by an unskilled laborer or a homeowner without the use of any tools.

Other objects of the invention are to provide an energy-saving apparatus which is lightweight, simple in construction and attractive in appearance. A secondary function of the invention is to impede the spread of fire in rooms having the invention installed by blocking the upward draft of hot air caused by the fire.

Accordingly, the present invention relates to an energy-saving cover apparatus having a cover means and a quick attachment means which will attach to an existing room air register and solve the problem of losing warm room air through the damper means in room air registers. Therefore, to the accomplishment of the foregoing objects, the invention consists of the features hereinafter fully described and particularly pointed out in the claims, the accompanying drawings and following disclosure describing in detail the invention, such drawings and disclosure illustrating, however, but two of the various ways in which the invention may be practiced.

DETAILED DESCRIPTION OF THE PREFERRED EMBODIMENT

Figure 1:
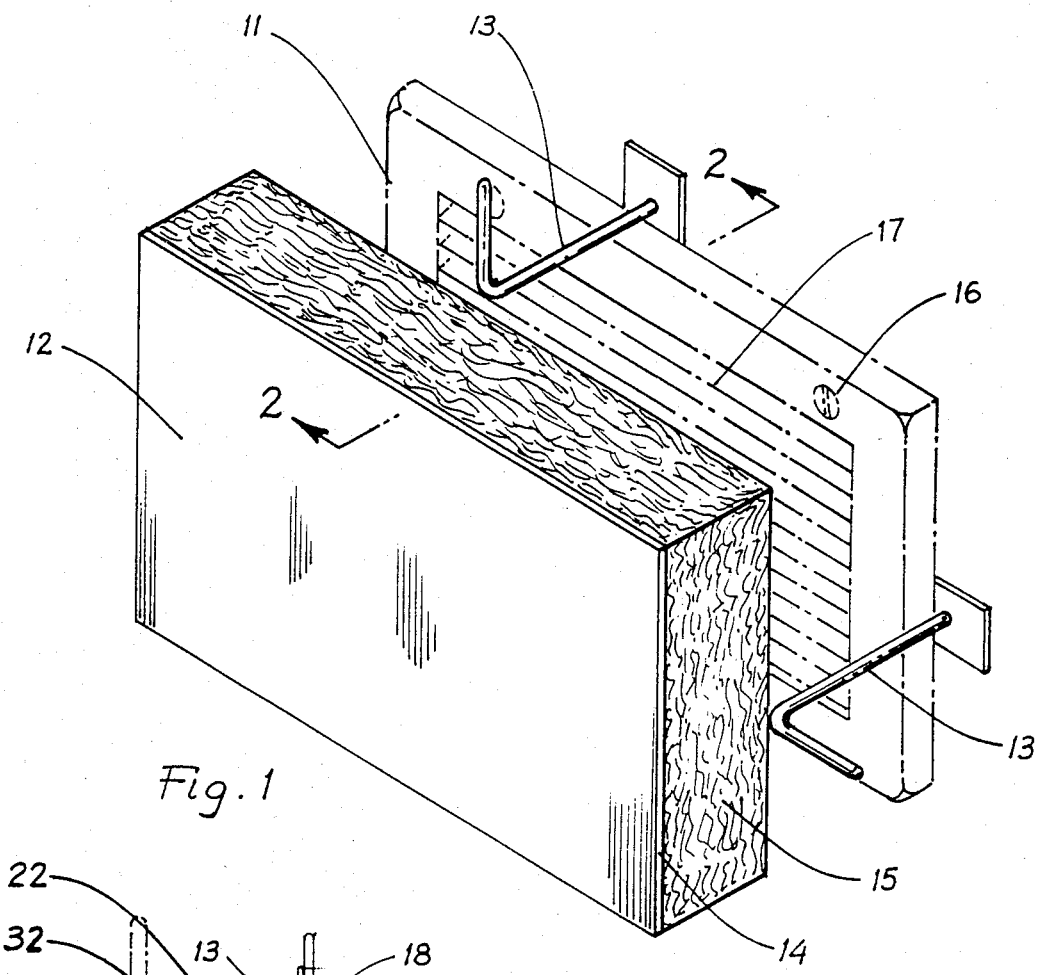
FIG. 1 is a perspective view showing the energy-saving cover prior to installation and the clamping attachment mechanism installed underneath the mounting face of the conventional room air register.

Referring now to the drawings and more particularly to FIG. 1, there is shown the conventional room air register 11 and energy-saving cover 12 prior to installation. Also shown there is clamping attachment mechanism 13 installed behind the register framework 26 and energy-saving cover 12 having a solid frontside 14 and a backside consisting of a closed-cell, cellulous fiber material 15.

Figure 2:
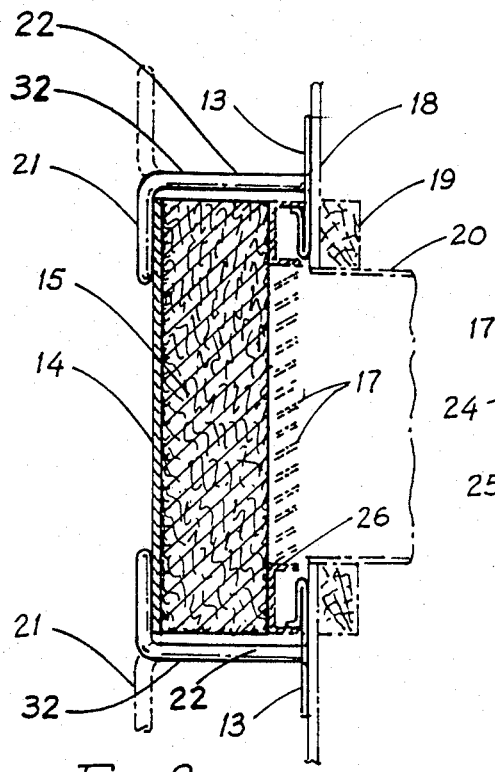
FIG. 2 is a section view as taken along line 2—2 of FIG. 1 and showing the energy-saving cover in a securely clamped position.

FIG. 2 in a cross-sectional view shows the energy-saving cover 12 releasably attached by the clamping attachment mechanism 13 to the face of the register 11 whereby the openings between louvers 17 are covered by the closed-cell, cellulous fiber material 14, or the like. The cover latching member 32 is seen to have shank portion 22 be pivotally connected such that 90 degree bent portion 21 can be rotably positioned either on the solid material 14 of the frontside of the energy-saving cover 12 or off the solid material 14. The shank portion 22 is suitably dimensioned such that when the 90 degree bent portion 21 is positioned onto the solid material of the frontside 14 there is an adequate compression of the fibrous material 15 to cause an air-tight seal between the energy-saving cover 12 and register 11. Likewise, the thickness of the fibrous material 15 is suitably selected such that any protrusions, such as louver closing handles (not shown), from the face of the register are engulfed by the fibrous material 15. Shown also in FIG. 2 is a typical register sub-framework comprising the ducting 20 and frame 19 to which register framework 26 is attached.

Figure 3:
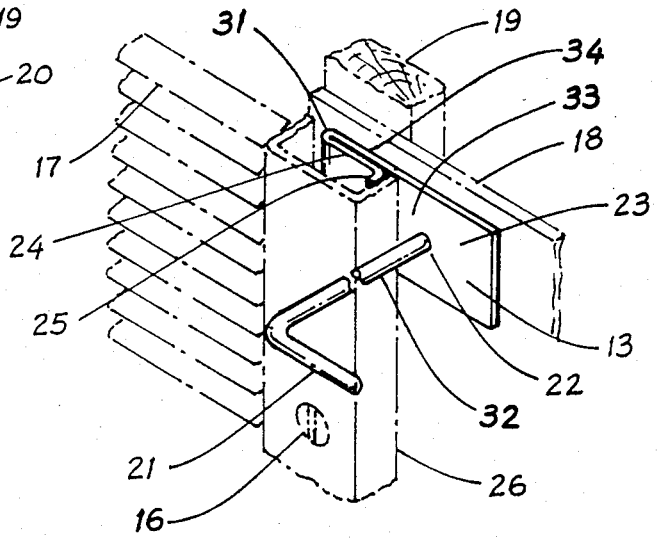
FIG. 3 is a fragmentary perspective view showing the detailed installation of the clamping attachment mechanism as installed underneath the mounting face of the conventional room air register.

As is best shown in FIG. 3 the clamping attachment mechanism 13 has a cover-latching member, generally at 32, having a pivotally attached shank portion 22 and 90 degree bent portion 21 and a register attachment member, generally at 33, having an exterior wall portion 23 and an interior wall portion 31. The exterior wall portion 33 providing a pivotal attachment point for shank portion 22. The interior wall portion 31 having a wall bearing part 34 and a backwardly bent parallel part 24 terminating in an upwardly bent part 25. The register attachment member 33 is intended to be insertably mounted between room wall 18 and register framework 26 by loosening register attachment screws 16 from room register sub-framework 19 and inserting interior wall portion 31 behind register framework 26. The register attachment member 33 is rigidly held in the installed position by means of the force imparted by the retightening of screws 16 upon the exterior wall portion 23 and wall bearing part 34. The resulting force causes upwardly bent part 25 to butt against the inner wall of the register framework 26.

Figure 4:
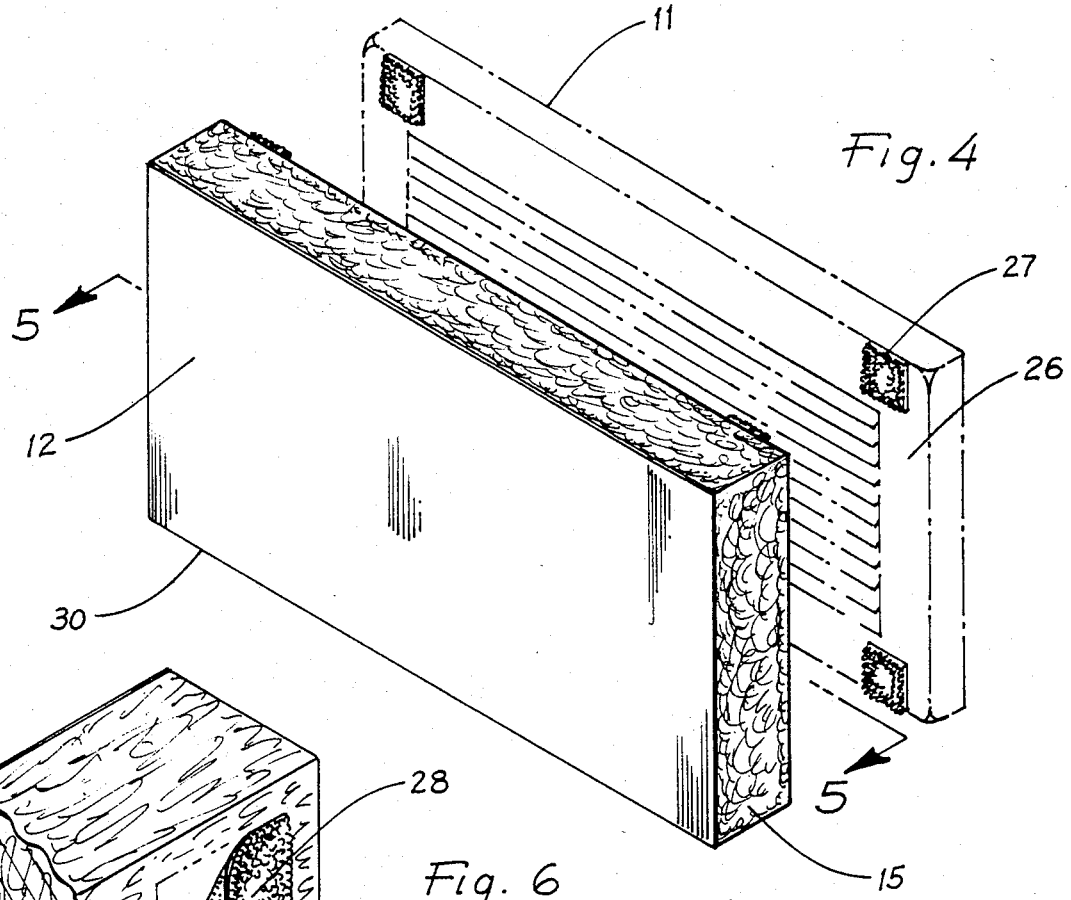
FIG. 4 is a perspective view showing an alternate embodiment of the invention prior to installation to the conventional room air register and particularly showing various strips of the material, sold under the tradename Velcro, installed to the face of a register as an alternative attachment means.
Figure 6:
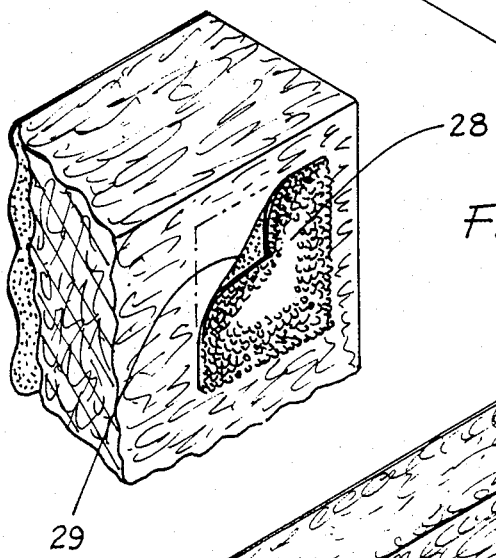
FIG. 6 is an enlarged partial view showing the details of installing the adhesive side of the Velcro (tradename) strips to the backside of the cover portion of the invention.
Figure 5:
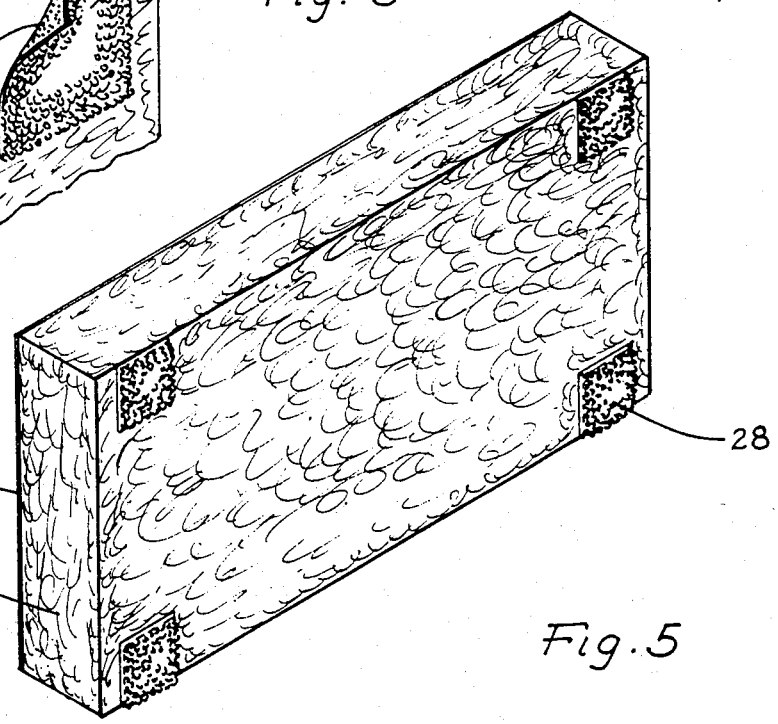
FIG. 5 is a view taken along line 5—5 of FIG. 4 showing the backside of the energy-saving cover with corresponding mating halves of the Velcro (tradename) strips.

FIGS. 4,5 and 6 show an alternative construction of the energy-saving cover 12 whereby the cover is releasably attached to the register 11 with a plurality of mating strips of material 27 and 28 sold under the tradename of Velcro. FIG. 4 shows first mating half 27 adhesively attached to register frame 26. FIG. 5 shows second mating half 28 adhesively attached to fibrous material 15. FIG. 6 shows an enlarged view whereby a typical second mating half 28 having adhesive back 29 is attached to fibrous material 15.

While the present invention has been shown and described herein in what is conceived to be the most practical and preferred embodiment, it is recognized that departures can be made therefrom within the scope of the invention, which is therefore not to be limited to the details disclosed herein but is to be accorded the full scope of the claims so as to embrace any and all equivalent devices.

I claim:

1. An energy-saving cover apparatus for preventing the loss of warm, room ambient air through a room air register of the type having a framework with an inner depending wall, said framework being attached to a ducting opening by attachment screws, comprising:

(a) a room air register cover means; and (b) attachment means for securing said room air register cover means to said room air register, said attachment means being a clamping attachment mechanism having a pivotal cover-latching member and a register attachment member; said cover-latching member having shank portion having one end pivotally attached to said register attachment member and other end being a 90 degree bent portion for clamping to the frontside of said cover means; said register attachment member being a narrow, flat strip of sheet metal, or similar material which can be formed, having an exterior wall portion and an interior wall portion, said exterior wall portion pivotally containing one end of said shank portion and said interior wall portion having a wall bearing part and a backwardly bent parallel part terminating in a substantially small upward bend, said interior wall portion also having sufficient length to be insertable behind the framework of said register after loosening the register attachment screws and thereat be rigidly retained upon reinstalling said register attachment screws by the resulting force upon said wall bearing part and said backwardly bent parallel part with terminating bent end butting against the inner wall of said register framework.

2. An energy-saving cover apparatus for preventing the loss of warm room ambient air through a room air register of the type having a framework with an inner depending wall, said framework being attached to ducting opening by attachment screws, comprising:

(a) a room air register cover means, said room air register cover means being shaped to fit the face of said register and having a front side and a backside, said front side being constructed of a solid, thin and decorative material and said backside being constructed of a closed-cell cellulose fiber material, said fibrous material being bonded to said solid material with a suitable adhesive and having sufficient thickness such that when installed against the face of said register any protrusions will be engulfed within the material and will not cause a fitting problem; and (b) attachment means for securing said room air register cover means, said attachment means being a clamping attachment mechanism having a pivotal cover-latching member and a register attachment member;

said cover-latching member having a shank portion having a length adequate to compress the energy-saving cover means against said register and cause a air-tight seal therebetween, said shank portion having one end pivotally attached to said register attachment member and other end having a 90 degree bent portion for clamping to said solid material on frontside of said energy-saving cover means;

said register attachment member being a narrow, flat strip of sheet metal, or similar material which can be formed, having an exterior wall portion and an interior wall portion, said exterior wall portion pivotally containing one end of said shank portion and said interior wall portion having a wall bearing part and a backwardly bent parallel part terminating in a substantially small upward bend, said interior wall portion also having sufficient length to be insertable behind the framework of said register after loosening the register attachment screws and thereat be rigidly retained upon reinstalling said register attachment screws by the resulting force upon said wall bearing part and said backwardly bent parallel part with terminating bent end butting against the inner wall of said register framework.

* * * * *